US005937835A

United States Patent [19]

Turner et al.

[11] Patent Number: 5,937,835

[45] Date of Patent: Aug. 17, 1999

[54] EGR SYSTEM AND IMPROVED ACTUATOR THEREFOR

[75] Inventors: David Turner, Bloomfield Hills; Edwin D. Lorenz, Grand Blanc; Glen R. Lilley, Bloomfield Hills, all of Mich.

[73] Assignee: Eaton Corporation, Cleveland, Ohio

[21] Appl. No.: 08/881,622

[22] Filed: Jun. 24, 1997

[51] Int. Cl.[6] ..... F02M 25/04

[52] U.S. Cl. ..... 123/568.24; 254/129.13

[58] Field of Search .... 123/568.23; 251/129.11–129.13

[56] References Cited

U.S. PATENT DOCUMENTS

| | | | |
|---|---|---|---|
| 4,473,056 | 9/1984 | Ishida et al. | 123/568.23 |
| 4,690,119 | 9/1987 | Makino et al. | 123/568.23 |
| 5,035,228 | 7/1991 | Bender | 123/568 |
| 5,094,218 | 3/1992 | Everingham et al. | 123/571 |
| 5,606,957 | 3/1997 | Feucht | 123/571 |
| 5,727,653 | 3/1998 | Grossenbacher et al. | 185/40 R |

*Primary Examiner*—Andrew M. Dollnar
*Assistant Examiner*—Arnold Castro
*Attorney, Agent, or Firm*—L. J. Kasper

[57] ABSTRACT

An exhaust gas recirculation (EGR) system (11), especially for a diesel engine, having a valve (25), including a valve stem (29,31) and an actuator operable to move the valve (25) between the open (FIG. 1) and closed positions. The actuator includes an electric motor (47) which provides a low torque, high speed rotary output (51) to an input gear (53) of a reduction gear train (55). The output of the gear train is a relatively high torque, low speed rotation of an output gear (79), which is connected by a linkage (83,85) to the input stem (31) of the valve. The gear train (55) includes a torque limiting clutch (67,69) to protect the teeth of the gears, and a coupling arrangement (91) joins the valve stems (29,31) to permit mis-alignment therebetween.

10 Claims, 4 Drawing Sheets

EGR SYSTEM AND IMPROVED ACTUATOR THEREFOR

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF DISCLOSURE

The invention relates to an exhaust gas recirculation system, for controlling the flow of exhaust gas from an exhaust gas passage to an engine intake passage of an internal combustion engine, and more particularly, to an actuator arrangement for an exhaust gas recirculation system.

Although the use of the present invention is not limited to any particular type of engine, its use is especially advantageous in connection with a diesel engine, for reasons which will become apparent subsequently.

Typically, exhaust gas recirculation (EGR) valves have been disposed between the engine exhaust manifold and the engine intake manifold, and operable, when in the open position, to recirculate exhaust gas from the exhaust side of the engine back to the intake side. As is well known to those skilled in the art, such recirculation of exhaust gases is helpful in reducing various engine emissions.

Many prior art EGR valves have been pressure responsive, and more particularly, have moved between the open and closed positions in response to movement of a diaphragm. One example of such an EGR valve control is shown in U.S. Pat. No. 5,035,228. Normally, the diaphragm is biased by a vacuum signal. However, many vehicles having diesel engines, and requiring EGR systems, do not inherently include a vacuum source. Therefore, the use of a vacuum actuated EGR valve, thus requiring the addition of a vacuum source, would add substantially to the overall cost of the EGR system.

An EGR system including an electrically operated type actuator is illustrated and described in U.S. Pat. No. 5,606,957. The actuator for the valve stem in the cited patent is a stepper motor, which is generally satisfactory in performing the basic function of opening and closing the EGR valve. However, in most vehicle applications for EGR valves, and especially in diesel engine applications, it must be possible to close the EGR valve within 50 milliseconds of the time the closing command is generated, and open the EGR valve within 100 milliseconds of the time the opening command is generated. Thus, the type of stepper motor actuator shown in the cited patent may be able to close the valve quickly enough, but clearly would not be able to open the valve within the required time.

BRIEF SUMMARY OF THE INVENTION

Accordingly, it is an object of the present invention to provide an improved exhaust gas recirculation system, which overcomes the disadvantages of the prior art systems.

It is a more specific object of the present invention to provide an actuator arrangement for an EGR valve which does not require a vacuum source, but instead, is electrically actuated and therefore is susceptible to more precise control.

It is a further object of the invention to provide an electrically actuated EGR valve which is able to open and close within a very short time period and with sufficient force.

The above and other objects of the invention are accomplished by the provision of an exhaust gas recirculation system for an internal combustion engine, the system having a valve including a valve stem, the valve being moveable between a closed position blocking communication from an engine exhaust gas passage to an engine intake passage, and an open position. The system comprises housing means and actuator means operable to move the valve between the closed and open positions in response to changes in an electrical input signal.

The improved system is characterized by the valve stem including an input portion disposed within the housing means. The actuator means includes an electric motor operably associated with the housing means and operable to provide a low torque, high speed rotary output in response to the electrical input signal. The actuator means further includes a gear train comprising at least an input gear adapted to receive the low torque, high speed rotary output of the electric motor, and an output gear providing a high torque, low speed rotary output. A linkage means is operable to translate the high torque, low speed rotary output into axial movement of the input portion of the valve stem, to move the valve between the closed and open positions.

DETAILED DESCRIPTION OF THE PREFERRED EMBODIMENT

Figure 1:
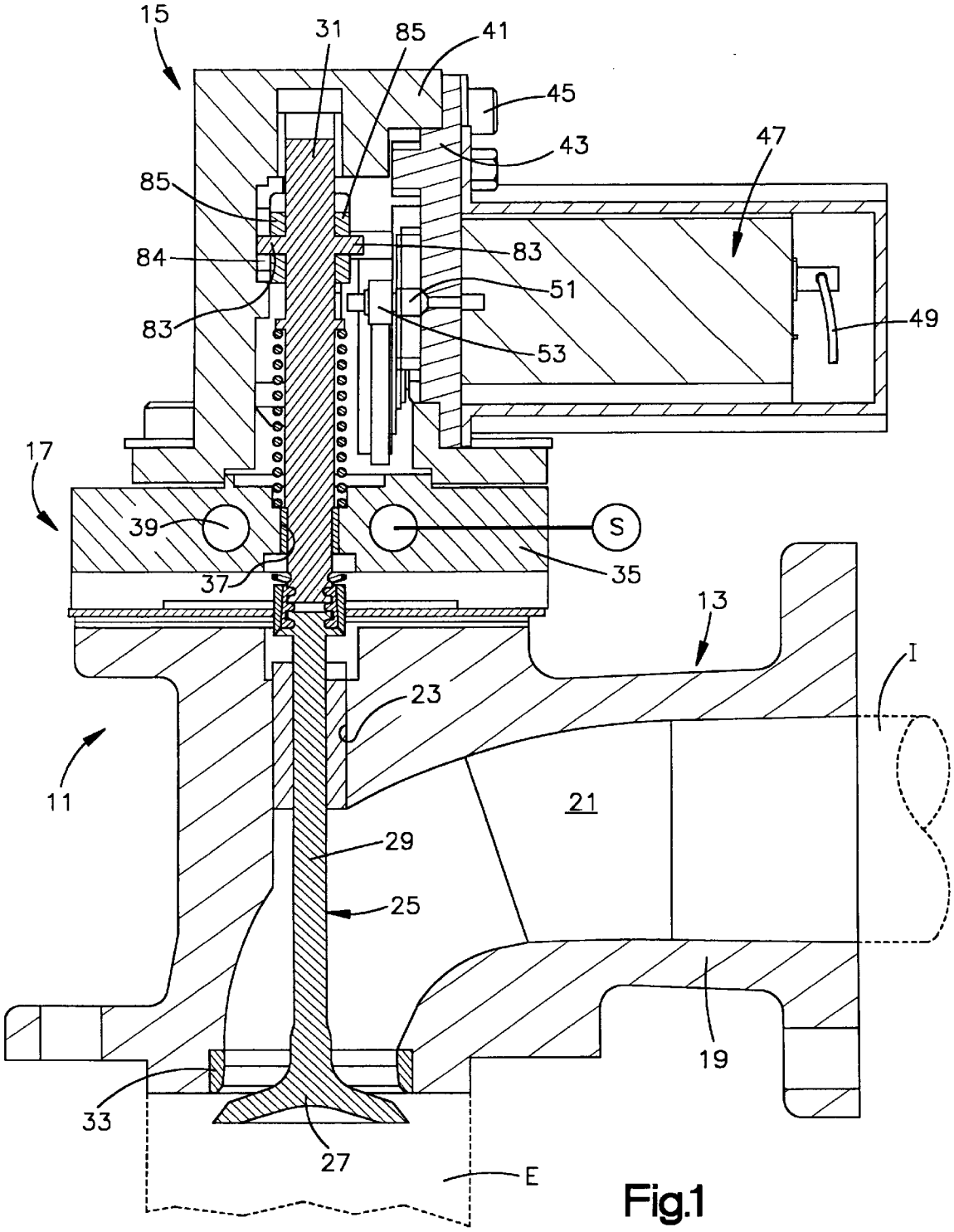
FIG. 1 is a transverse cross-section of an exhaust gas recirculation valve and control system therefore, made in accordance with the present invention.

Referring now to the drawings, which are not intended to limit the invention, FIG. 1 illustrates an exhaust gas recirculation system, generally designated 11. As is well known to those skilled in the art, the EGR system 11 may include a plurality of sections, and the subject embodiment includes a manifold portion 13, an actuator portion 15, and a heat transfer (cooling) portion 17, the cooling portion 17 being disposed between the manifold portion 13 and the actuator portion 15.

As is also well known to those skilled in the art, an EGR system may be plumbed into the engine exhaust and intake system in a number of ways, the specific arrangement for doing so not comprising part of the present invention, and therefore, a plumbing arrangement will be illustrated herein, only schematically, and only by way of example.

The manifold portion 13 comprises a manifold housing 19 defining a passage 21, and a bore 23 within which a valve assembly, generally designated 25 is reciprocally supported for axial movement therein. The valve assembly 25 includes a poppet valve 27 formed integrally with a valve stem 29. The valve assembly 25 also includes an input stem portion 31 which will be discussed in greater detail subsequently.

The manifold housing 19 includes a valve seat 33, against which the poppet valve 27 seats when the valve assembly 25 is closed, such that the valve seat 33 serves as the "close stop". However, in FIG. 1, the valve 27 is shown in its open position. At the upstream end of the passage 21 (adjacent the valve seat 33), the manifold portion 13 is connected to an exhaust gas passage E, and at the downstream end of the passage 21, the manifold portion 13 is connected to an intake passage I.

Figure 3:
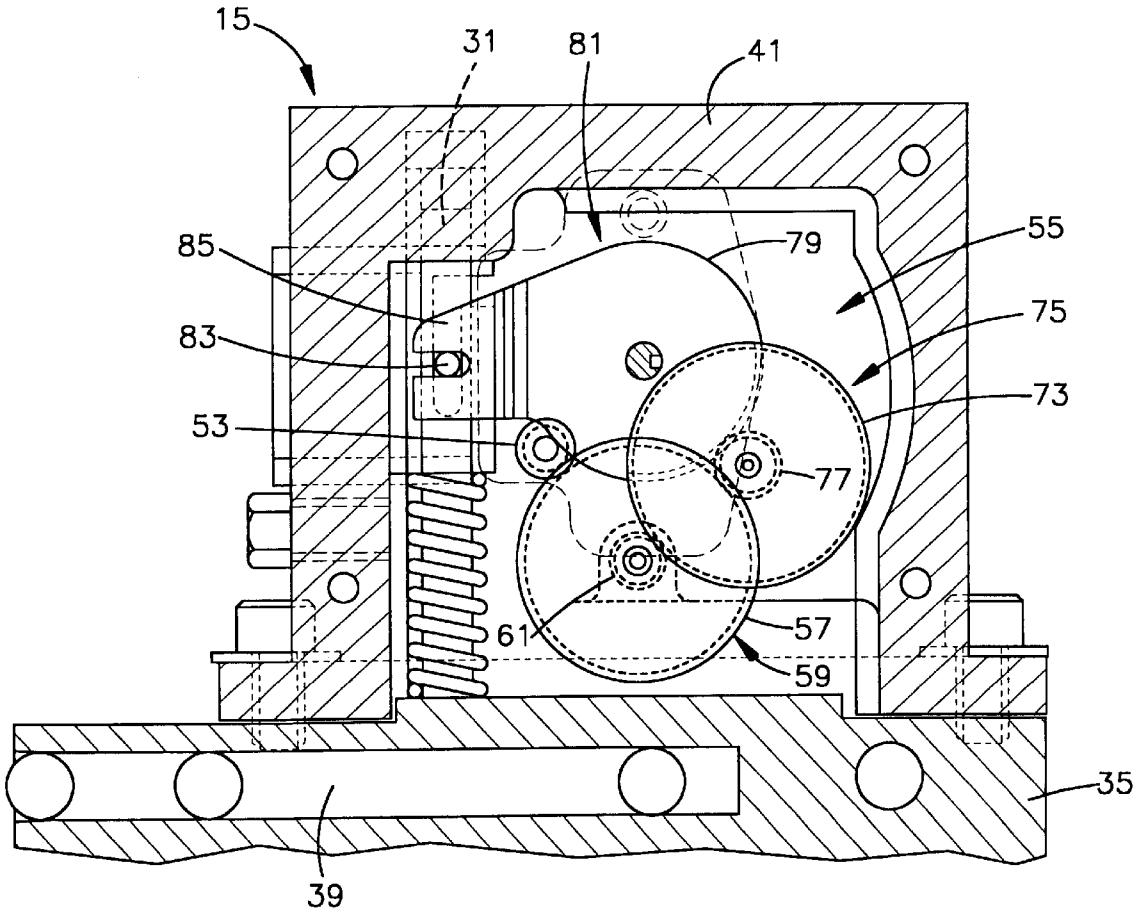
FIG. 3 is a cross-section, on a slightly larger scale than FIG. 1, but taken on a plane normal to that of FIGS. 1 and 2.

Referring now primarily to FIGS. 1 and 3, the heat transfer (cooling) portion 17 includes a cooling housing 35 defining a central opening 37 (see FIG. 5) through which the input stem portion 31 extends. The cooling housing 35 also defines a cooling passage 39, which is shown schematically in FIG. 1 as being in communication with a source S of coolant fluid, e.g., fluid which comprises part of the engine coolant system. As is well known to those skilled in the art, the communication of the manifold portion 13 with hot exhaust gases from the exhaust passage E will result in the manifold housing 19 becoming quite hot, e.g., 300 or 400 degrees Fahrenheit. In accordance with one aspect of the invention, the cooling portion 17 is disposed between the manifold portion 13 and the actuator portion 15, to serve as a thermal barrier, to keep the actuator portion 15 as cool as possible, and preferably under about 200 degrees Fahrenheit.

Figure 2:
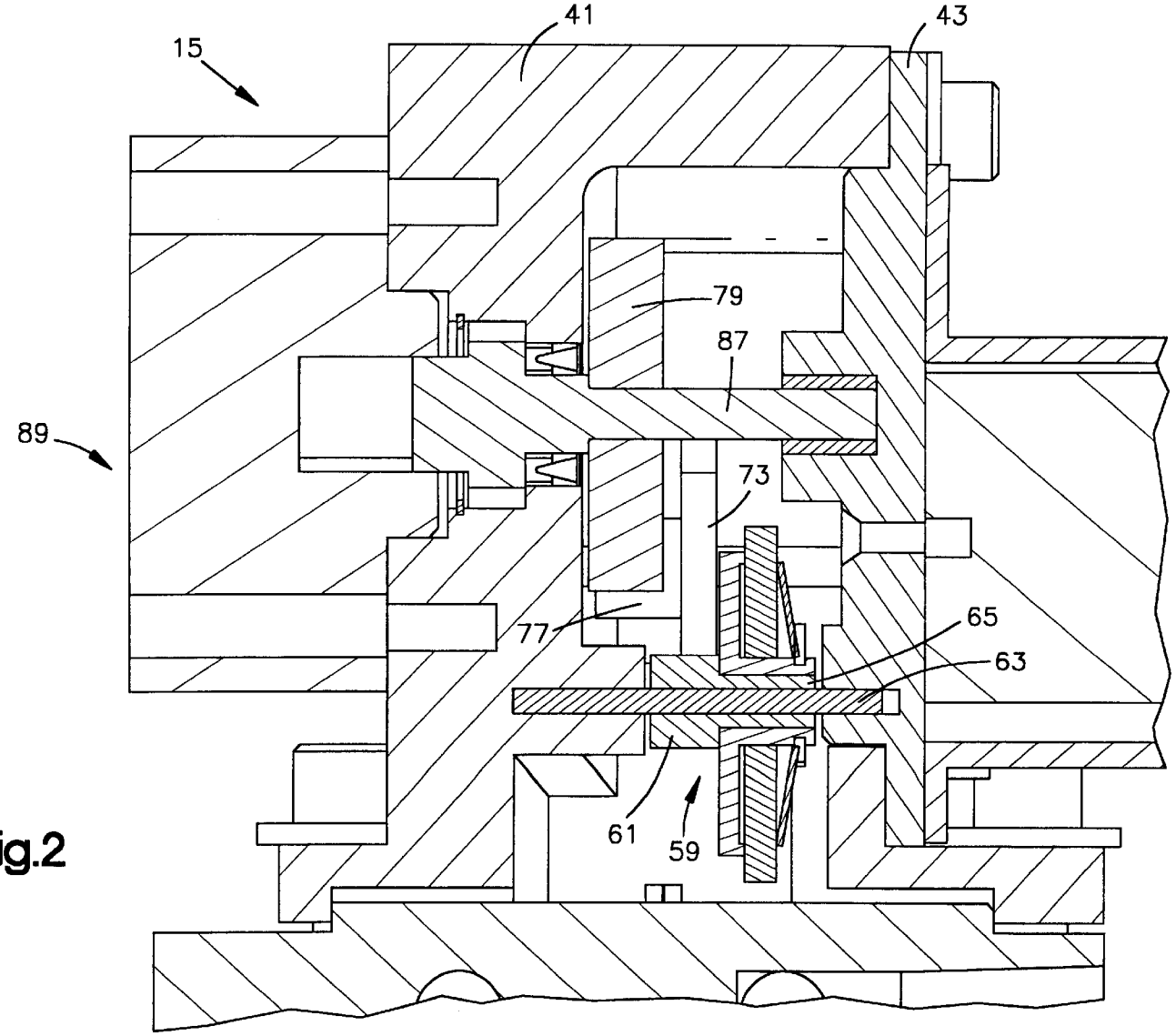
FIG. 2 is an enlarged, fragmentary, transverse cross-section, similar to FIG. 1, but taken on a slightly different plane, and illustrating one aspect of the actuator assembly of the present invention.

Referring now primarily to FIGS. 1–3, the actuator portion 15 will be described in some detail. The actuator portion 15 includes an actuator housing 41 and a housing cover 43, attached to the housing 41 by any suitable means, such as a plurality of bolts 45. Attached to the exterior of the housing cover 43 is the casing of an electric motor, generally designated 47, the particular construction and specifications of which are not essential to the present invention. However, in accordance with one aspect of the invention, the electric motor 47 is of the relatively high speed, continuously rotating type, as opposed to a stepper type of motor discussed in the BACKGROUND OF THE DISCLOSURE. Although the motor 47 could, within the scope of the invention, comprise a brushless DC motor, it is preferred to use a permanent magnet DC commutator motor, or any other motor with a high torque-to-inertia ratio.

The motor 47 receives an electrical input by means a pair of electrical wires, only one of which is shown in FIG. 1, and which is designated 49. The electric motor 47 provides a low torque, high speed rotary output at a motor output shaft 51 (see FIG. 1) on which is mounted a motor pinion gear 53 (see FIGS. 1 and 3).

The motor pinion gear 53 comprises the input gear of a gear train generally designated 55, the general function of which is to translate the relatively low torque, high speed rotary output of the motor 47 into a relatively high torque, low speed rotary output which may be transmitted to the valve assembly 25. The motor pinion gear 53 is in meshing engagement with a relatively larger gear 57 of an intermediate gear assembly 59, which also includes a relatively smaller pinion 61. The gear 57 and pinion 61 are referred to as being "relatively larger" and "relatively smaller", respectively, merely to indicate that the function of the gear train 55 is progressively to reduce the speed while increasing the torque, and thus, it is believed to be within the ability of those skilled in the art to select particular gears and pinions, and the tooth ratio therebetween.

Figure 4:
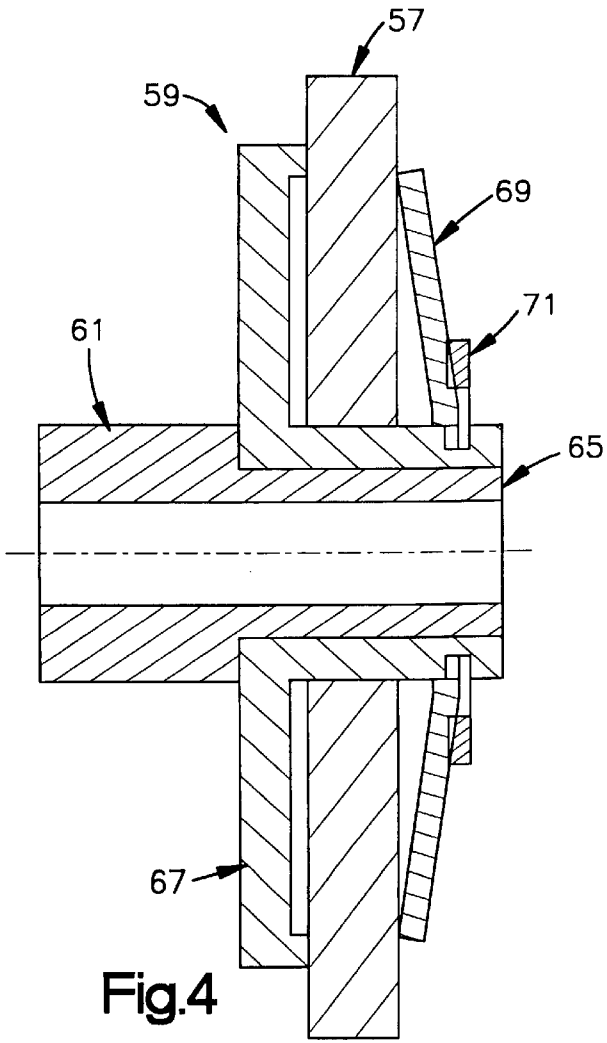
FIG. 4 is an enlarged transverse cross-section, similar to FIG. 2, illustrating the torque limiting clutch assembly, which is one aspect of the present invention.

Referring now primarily to FIGS. 2 and 4, the intermediate gear assembly 59 preferably comprises a torque limiting (slipping) coupling. It should be understood that the particular construction and operation of the coupling shown in FIG. 4 is not an essential feature of the present invention, but is shown by way of example only. As may best be seen in FIG. 2, the pinion 61 has a pinion shaft 63 rotatably disposed within a cylindrical portion 65 of the pinion 61, the pinion shaft 63 being journalled at its opposite ends by the housing 41 and the cover 43.

Referring now primarily to FIG. 4, disposed between the cylindrical portions 65 of the pinion 61 and the gear 57 is a slip member 67, which is fixed to rotate with the cylindrical portion 65 of the pinion 61 by any suitable means. The gear 57 is biased into engagement with the slip member 67, and normally rotates therewith, by means of a beveled washer 69, having its radially inner portion restrained by a retainer ring 71. As is well known to those skilled in the art of torque limiting or slip clutches, the gear 57 and pinion 61 will rotate as a unit up to a predetermined, maximum input torque, above which the torque will exceed the capacity of the beveled washer 69, and the gear 57 will begin to slip relative to the slip member 67 (and therefore, relative to the pinion 61).

The reason for including this slipping capability in the intermediate gear assembly 59 is primarily to protect the gear train 55. A major portion of the torque generated by the electric motor 47 is required simply to overcome the inertia of the motor itself. With the full current being directed to the motor 47, the teeth of the gear train 55 would be destroyed whenever the valve 27 reached its closed stop or its open stop in the absence of the torque limiting (slipping) clutch capability described above. Within the scope of the present invention, the torque limiting clutch may comprise a separate element in the gear train 55, but preferably is combined with an intermediate gear assembly to make the entire gear train more compact and less expensive.

The pinion 61 is in meshing engagement with a relatively larger gear 73 of an intermediate gear assembly 75, the output of which is a relatively smaller pinion 77. In the subject embodiment, the intermediate gear assembly 75 may simply comprise the gear 73 and pinion 77 being fixed to rotate with each other, or, alternatively, may comprise a single, integrally formed part. The function of the intermediate gear assembly 75 is to reduce further the speed, while increasing further the torque being transmitted by the gear train 55.

The pinion 77 is in meshing engagement with a relative larger diameter gear portion 79 of a sector gear, generally designated 81. As may best be seen in FIG. 1, formed integrally with the input stem portion 31 of the valve assembly 25 is a pair of diametrically opposed cylindrical projections 83, one of which is received within a slot 84 defined by the housing 41. The engagement of the projection with the bottom portion (in FIG. 1) of the slot 84 comprises the "open stop". The sector gear 81 includes a pair of opposed actuator portions 85 (only one of which is shown in FIG. 3, but both of which are shown in FIG. 1). Each of the actuator portions 85 includes an elongated, generally U-shaped opening which receives the cylindrical projection 83. Thus, the sector gear 81 comprises the high torque, low speed rotary output of the gear train 55 and the projections 83 and actuator portions 85 comprise a linkage means which is operable to translate the high torque, low speed rotary output into axial movement of the stem portion 31, and of the entire valve assembly 25.

Those skilled in the art will understand that the use of the terms "low" and "high" in reference to the speeds and torque of the input to the gear train 55, and the output therefrom, is meant in the relative sense. Thus, the reference to a "low speed" output from the gear train simply means a low speed relative to the speed into the gear train, and doesn't mean a low speed in the sense that a stepper motor would provide a low speed.

As may best be seen in FIG. 2, the larger gear portion 79 is preferably pressed onto a shaft 87, the opposite ends of which are journalled in the actuator housing 41 and in the housing cover 43. It should be noted that, disposed adjacent the left end of the shaft 87, and attached to the housing 41 is a sensor assembly, generally designated 89, the function of which is to sense the angular position of the shaft 87 (which is representative of the angular position of the sector gear 81, and therefore, is representative of the position of the poppet valve 27). The sensor 89 converts the angular position of the shaft 87 into an appropriate electrical signal, which then may be transmitted as an input to the control logic (not shown herein) for the EGR system 11. Such control logic is outside the scope of the present invention, and will not be illustrated or described herein.

Figure 5:
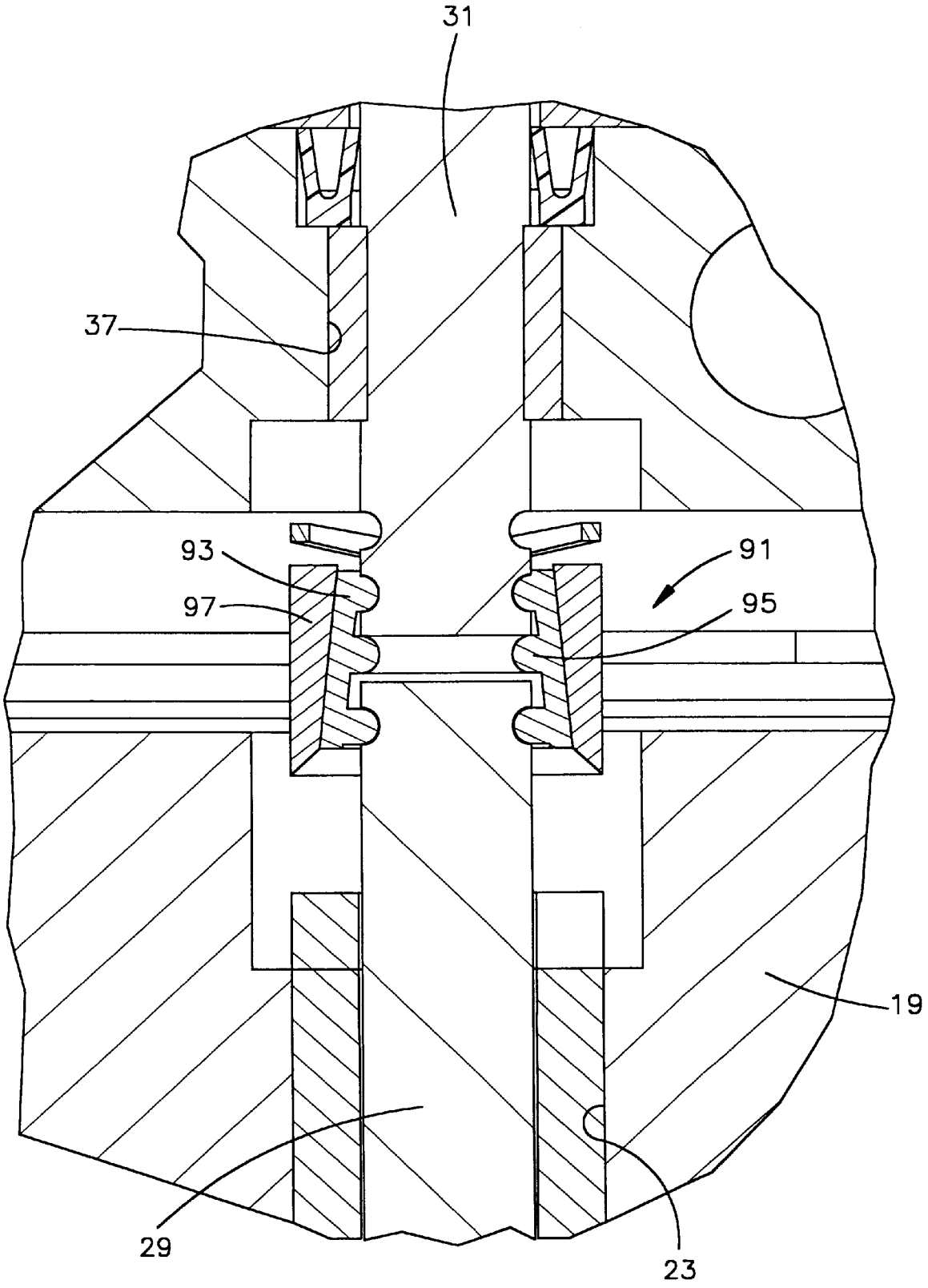
FIG. 5 is a further enlarged transverse cross-section, similar to FIG. 1, illustrating the valve stem coupling arrangement which is another aspect of the present invention.

Referring now to FIG. 5, in conjunction with FIG. 1, there is illustrated a coupling arrangement, generally designated 91, the general function of which is to couple the input stem 31 to the valve stem 29, such that the input stem 31 and the valve stem 29 have common axial movement. However, in accordance with a preferred embodiment, the coupling arrangement 91 is operable to permit transverse misalignment of the input stem 31 and the valve stem 29, such that the transverse alignment among the manifold housing 19, cooling housing 35, and actuator housing 41 is less critical. In the subject embodiment, the coupling arrangement 91 comprises a butt key type of keeper arrangement, including a pair of butt key members 93 and 95, surrounded by a collar member 97. As is well known to those skilled in the "keeper" art, the butt key members 93 and 95 are butted together, but preferably do not contact the keeper grooves on either the stem 29 or the stem 31, thus permitting the stems to rotate relative to each other, although such is not an essential feature of the coupling arrangement 91.

The invention has been described in connection with open and close stops, but those skilled in the art will understand that such stops are provided primarily in the event of a failure of the system control logic. Under normal operating conditions, the movement of the valve assembly 25, as far as establishing its open and closed positions, will be controlled by the system logic, which in turn controls the signal 49.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. An exhaust gas recirculation system for an internal combustion engine, said system having a valve including a valve stem, said valve being moveable between a closed position, blocking communication from an engine exhaust gas passage to an engine intake passage, and an open position; said system comprising housing means, and actuator means operable to move said valve between said closed and open positions, in response to changes in an electrical input signal; characterized by:

(a) said valve stem including an input portion disposed within said housing means;

(b) said actuator means including an electric motor operably associated with said housing means and operable to provide a low torque, high speed rotary output in response to said electrical input signal;

(c) said actuator means further including a gear train comprising at least an input gear, adapted to receive said low torque, high speed rotary output of said electric motor, and an output gear providing a high torque, low speed rotary output;

(d) linkage means operable to translate said high torque, low speed rotary output into axial movement of said input portion of said valve stem, to move said valve between said closed and open positions;

(e) said gear train including a motor pinion gear comprising said input gears, and at least one intermediate sear assembly comprising a relatively larger gear member in toothed engagement with said motor pinion gear, and a relatively smaller pinion, normally operable to rotate with said larger gear, and operable to provide a reduction in speed of rotation, and an increase in torque from said input gear to said output gear; and (f) gear train including torque limiting clutch means operable to limit the amount of torque transmitted to said output gear as said valve approaches an open stop and a closed stop.

2. An exhaust gas recirculation system as claimed in claim 1, characterized by said housing means comprising a manifold portion defining a valve seat, and providing communication from said exhaust gas passage to said intake passage.

3. An exhaust gas recirculation system as claimed in claim 2, characterized by said housing means comprising a gear housing portion, and a cooling housing disposed between said gear housing portion and said manifold portion, said cooling housing defining a cooling passage and adapted to be connected to a source of coolant fluid.

4. An exhaust gas recirculation system as claimed in claim 2, characterized by said valve including said input portion and a stem portion, said input and stem portions comprising separate members, said stem portion being journalled within said manifold portion of said housing means, and said input portion being journalled within a gear housing portion of said housing means.

5. An exhaust gas recirculation system as claimed in claim 4, characterized by coupling means operable to couple said stem portion and said input portion for common axial movement, said coupling means being operable to permit transverse misalignment of said stem portion and said input portion.

6. An exhaust gas recirculation system as claimed in claim 1, characterized by said intermediate gear assembly includes said torque limiting clutch means, disposed operationally between said larger gear member and said smaller pinion, whereby said gear member and said pinion are normally operable to rotate together, up to a predetermined maximum torque level.

7. An exhaust gas recirculation system as claimed in claim 1, characterized by said electric motor comprises a motor having a relatively high torque-to-inertia ratio.

8. An exhaust gas recirculation system as claimed in claim 7, characterized by said electric motor comprises a permanent magnet DC commutator motor.

9. An exhaust gas recirculation system for an internal combustion engine, said system having a valve including a valve stem, said valve being moveable between a closed position, blocking communication from an engine exhaust gas passage to an engine intake passage, and an open position; said system comprising housing means, and actuator means operable to move said valve between said closed and open positions, in response to changes in an electrical input signal; characterized by:

(a) said valve stem including an input portion disposed within said housing means;

(b) said actuator means including an electric motor operably associated with said housing means and operable to provide a low torque, high speed rotary output in response to said electrical input signal;

(c) said actuator means further including a gear train comprising at least an input gear, adapted to receive said low torque, high speed rotary output of said electric motor, and an output gear providing a high torque, low speed rotary output;

(d) linkage means operable to translate said high torque, low speed rotary output into axial movement of said input portion of said valve stem, to move said valve between said closed and open positions;

(e) said housing means comprising a manifold portion defining a valve seat, and providing communication from said exhaust gas passage to said intake passage; and (f) said valve including said input portion and a stem portion, said input and stem portions comprising separate members, said stem portion being journalled within said manifold portion of said housing means, and said input portion being journalled within a gear housing portion of said housing means.

10. An exhaust gas recirculation system as claimed in claim 9, characterized by said housing means comprising a gear housing portion, and a cooling housing disposed between said gear housing portion and said manifold portion, said cooling housing defining a cooling passage and adapted to be connected to a source of coolant fluid.

* * * * *